US007491891B2

(12) United States Patent
Izumida et al.

(10) Patent No.: US 7,491,891 B2
(45) Date of Patent: Feb. 17, 2009

(54) COMPOSITE WIRE FOR WIRE-HARNESS AND PROCESS FOR PRODUCING THE SAME

(75) Inventors: Hiromu Izumida, Hyogo (JP); Nozomu Kawabe, Hyogo (JP); Teruyuki Murai, Hyogo (JP); Shinei Takamura, Hyogo (JP)

(73) Assignees: Sumitomo (SEI) Steel Wire Corp., Hyogo (JP); Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 146 days.

(21) Appl. No.: 11/596,924

(22) PCT Filed: May 19, 2004

(86) PCT No.: PCT/JP2004/006724

§ 371 (c)(1),
(2), (4) Date: Nov. 17, 2006

(87) PCT Pub. No.: WO2005/112046

PCT Pub. Date: Nov. 24, 2005

(65) Prior Publication Data

US 2007/0221396 A1 Sep. 27, 2007

(51) Int. Cl.
*H01B 5/00* (2006.01)

(52) U.S. Cl. ..... 174/126.2

(58) Field of Classification Search ..... 174/110 R, 174/120 R, 121, 102 R, 103, 106 R
See application file for complete search history.

(56) References Cited

U.S. PATENT DOCUMENTS

| | | | | |
|---|---|---|---|---|
| 3,340,048 | A * | 9/1967 | Floreen | 420/36 |
| 3,772,005 | A * | 11/1973 | DEBarbadillo, II | 420/37 |
| 4,810,593 | A | 3/1989 | Yamamoto et al. | |
| 6,630,103 | B2 * | 10/2003 | Martin et al. | 420/38 |
| 2003/0049153 | A1 * | 3/2003 | Martin et al. | 420/38 |

FOREIGN PATENT DOCUMENTS

| | | | |
|---|---|---|---|
| EP | 0 331 182 | B2 | 4/1994 |
| JP | 63-23015 | | 5/1988 |
| JP | 1-225006 | A | 9/1989 |
| JP | 1-283707 | A | 11/1989 |
| JP | 6-60739 | A | 3/1994 |
| JP | 7-31939 | | 4/1995 |
| JP | 2002-146483 | A | 5/2002 |
| JP | 2003-226940 | A | 8/2003 |
| JP | 3530181 | | 3/2004 |
| JP | 2004-281241 | A | 10/2004 |

* cited by examiner

*Primary Examiner*—William H Mayo, III
(74) *Attorney, Agent, or Firm*—McDermott Will & Emery LLP

(57) ABSTRACT

A wire-harness use composite wire comprising a first element wire which comprises 0.01-0.25 mass % C, 0.01-0.25 mass % N, 0.5-4.0 mass % Mn, 16-20 mass % Cr,8.0-14.0 mass % Ni, and the balance of Fe and impurities and satisfies that a C+N content is in the range of 0.15 mass %≦C+N≦0.30 mass %, and a second element wire comprising at least one material selected from the group consisting of copper, copper alloy, aluminum, and aluminum alloy, the first element wire and the second element wire being twisted together.

3 Claims, No Drawings

COMPOSITE WIRE FOR WIRE-HARNESS AND PROCESS FOR PRODUCING THE SAME

RELATED APPLICATIONS

This application is the U.S. National Phase under 35 U.S.C. § 371 of International Application No. PCT/JP2004/006724, filed on May 19, 2004 the disclosure of which Application is incorporated by reference herein.

TECHNICAL FIELD

The present invention relates to a wire-harness use composite wire suitable for automotive wire harness and to a production method thereof More particularly, the present invention relates to a composite wire designed for wire harness that can provide improved corrosion resistance while having excellent electrical conductivity and strength, and to a production method thereof.

BACKGROUND ART

An automobile is commonly equipped in an interior thereof with a wire harness (internal wiring), via which power supply, signal communication, sensing, etc. to automotive electric components are provided. The wire harness primarily comprises automotive electric wires, protection members, and connectors, and metal wires consisting primarily of copper are generally used for conductors of the automotive electric wires.

In the light of the demand in recent years for improvement in fuel consumption of automobile, weight saving of automotive components is promoted. The demand for weight saving of the wire harness is also unexceptional. In addition, in the light of the need for resources saving and recycle of resources, reduction in quantity of copper used is also demanded.

Two prominent characteristics are required for the electric wire. One is electric conductivity and another is strength of the electric wire. Since copper often used for the conductor of the automotive electric wire is a metal of very low in electrical resistance, even a copper wire having a relatively small wire diameter can provide sufficient conductivity for the electric wire, but it is required to be increased in diameter to a certain extent to keep a required strength for the electric wire. In view of this, the copper wire is required to keep a required strength of the electric wire, while reducing an amount of copper used.

On the other hand, there is proposed a conductor having a copper layer around an outside of the stainless steel wire (Cf. Patent Document 1: JP Laid-open (Unexamined) Patent Publication No. Hei 1-283707, and Patent Document 2: JP Examined Patent Publication No. Hei 7-31939, for example). Additionally, there is proposed a twisted wire formed by twisting together the stainless steel wire and the copper wire (Cf. Patent Document 3: JP Examined Patent Publication No. Sho 63-23015, and Patent Document 4: JP Laid-open (Unexamined) Patent Publication No. Hei 1-225006, for example).

Patent Document 1: JP Laid-open (Unexamined) Patent Publication No. Hei 1-283707, Patent Document 2: JP Examined Patent Publication No. Hei 7-31939, Patent Document 3: JP Examined Patent Publication No. Sho 63-23015, and Patent Document 4: JP Laid-open (Unexamined) Patent Publication No. Hei 1-225006.

DISCLOSURE OF THE INVENTION

Problem to be Solved by the Invention

Using a metal wire formed of other metal than copper or of a copper alloy for the conductor of the automotive electric wire is conceivable as a measure for keeping a required strength of the electric wire while reducing an amount of copper used. For example, aluminum of lightweight can be cited as the metal other than copper. But, aluminum is lower in toughness than copper. Due to this, an aluminum wire has the disadvantage that when a terminal is crimped to the electric wire, the aluminum wire is easily damaged or broken. It is conceivable that aluminum wire is heat-treated or alloyed with other metal to increase the toughness to prevent the damage or break when crimped, but the aluminum wire heat-treated or alloyed with other metal may possibly be decreased in strength. Therefore, this is not necessarily a sufficient solution. On the other hand, using a copper alloy wire has a limit to reduction in amount of copper used and in weight, when considering the required strength for the electric wire, because a copper alloy wire cannot be expected in the first place to provide a significantly improved strength.

It is conceivable therefore that the conductor is formed by combining two or more metals, rather than by using only a single metal mentioned above. For example, as described by Patent Documents 1 and 2, the conductor produced by forming a copper layer of a cross-section ratio of 5-70% around the outside of the stainless steel wire by plating or by cladding is low in conductor resistance and also excellent in strength and toughness of the electric wire. However, the production of those conductors requires the process that after the stainless steel wire is produced, the copper layer is formed around the wire, thus requiring time to produce and causing significant cost increase for forming the copper layer by an existing plating process or by an existing cladding process.

On the other hand, by twisting together the metal wire of copper and the like and the stainless steel wire commonly having an excellent strength, the twisted wire as described by Patent Document 3 or 4 may be produced at relatively low cost while providing an increased strength of the electric wire. However, Patent Documents 3 and 4 do not at all refer to the construction for providing further improved corrosion resistance. For example, the twisted wire described by Patent Document 3 has excellent strength and sufficient corrosion resistance for a messenger wire to withstand use in a waterfront area and the like place by using especially metal wire of ferritic stainless steel, such as SUS430, and an annealed copper wire for electric purpose, as described in Example(s) of Patent Document 3. However, the conductor of the electric wire for automotive purpose, which is usually exposed to a corrosion atmosphere in the condition in which the electric current flows frequently, is exposed to harsher conditions than the messenger wire through which the electric current does not pass frequently. Due to this, the conductor using a ferritic stainless steel or an annealed copper wire as mentioned above for electric purpose cannot fully satisfy the required corrosion resistance for the conductor of the electric wire for automotive purpose. Although the twisted wire described by Patent Document 4 is the conductor for the wire harness purpose, it is desired to have a further improved corrosion resistance to electrochemical corrosion.

It is conceivable therefore that for example austenitic stainless steel commonly having a high corrosion resistance, such as SUS304, is used for the stainless steel wire described by Patent Documents 1-4. However, even when such stainless steel is used, there is a possibility that a martensite phase may be induced by a wiring process for providing improved tensile strength and breaking load, such as a wire drawing process and a stranding process, to cause reduction in corrosion resistance. SUS316 and SUS310 are known as the austenitic stainless steel having higher corrosion resistance, but these stainless steels do not have a higher strength than SUS304 has. Due to this, when the electric wire is formed using the stainless steel wire of SUS316 or SUS310 in combination, with the copper wire reduced to such an extent that can ensure a required conductivity for the wire harness, such an electric wire cannot be expected to provide an improved strength.

It is a primary object of the present invention to provide a wire-harness use composite wire having a further improved corrosion resistance, while having excellent conductivity and strength.

It is another object of the present invention to provide a production method of a wire-harness use composite wire that can produce the wire-harness use composite wire at a lower cost, while providing weight saving with a reduced amount of copper used.

Means for Solving the Problem

According to the present invention, an element wire of copper and the like metal is twisted together with an element wire of stainless steel of specific composition, to accomplish the objects mentioned above.

In detail, the present invention provides a wire-harness use composite wire comprising a first element wire which comprises 0.01-0.25 mass % C, 0.01-0.25 mass % N, 0.5-4.0 mass % Mn, 16-20 mass % Cr, 8.0-14.0 mass % Ni, and the balance of Fe and impurities and satisfies that a C+N content is in the range of 0.15 mass %≦C+N≦0.30 mass %, and a second element wire comprising at least one material selected from the group consisting of copper, copper alloy, aluminum, and aluminum alloy, the first element wire and the second element wire being twisted together.

First of all, according to the present invention, since the first element wire of stainless steel and the second element wire of copper or other metal are used in combination, the wire-harness-use composite wire can keep the required wiring strength while having sufficient conductivity. Also, since an amount of copper used is reduced, weight saving can also be achieved. In addition, by twisting those element wires together, the wire-harness-use composite wire can be produced at a lower cost. Further, since two or more different metals are used in combination, reduction in toughness of the wire-harness-use composite wire can be reduced, as compared with the conductor consisting of a single metal, such as aluminum only. Furthermore, since C and N in particular, which are austenite forming elements, are increased in amount added as the composition of the stainless steel wire of the first element wire, improved austenite stabilization can be provided to prevent formation of a martensitic phase which may be induced by the wiring process such as the wire drawing process and the stranding process, thus providing improved corrosion resistance. Also, due to the solid solution strengthening effect resulting from C and N as mentioned above, the harness-wire-use composite wire can provide increased tensile strength, as compared with the conventional austenitic stainless steel wire, thereby providing an increased strength. In the following, the present invention will be described in further detail.

(First Element Wire)

The stainless steel wire used in the present invention contains in particular interstitial solid solution elements of C and N more than the general austenitic stainless steel does. When the interstitial solid solution elements of C and N are contained in the matrix of the austenite phase (γ phase), not only the phase stability of the γ phase but also the generation of the crystal lattice strain to strengthen the metal are provided and thereby the solid solution strengthening effect and the effect of dislocation anchoring (Cottrell atmosphere) are produced. These effects can allow the stainless steel used in the present invention to keep corrosion resistance as well or better than SUS 316 even when undergoing the wire drawing process for providing improved tensile strength and the stranding process for providing improved strength of the twisted wires in addition to keep high mechanical characteristic. According to the present invention, in order to obtain these excellent effects, a total amount of C and N contained in the stainless steel wire (a C+N content) is set to be in the range of between 0.15 mass % and 0.30 mass %. When the C+N content is less than 0.15 mass %, the solid solution strengthening and the dislocation anchoring are insufficiently provided, so that it becomes hard to provide improvement in strength and in corrosion resistance. On the other hand, when the C+N content is more than 0.30 mass %, carbide and nitride increase in amount produced in the casting process, so that blowholes tend to take place, while in addition it becomes hard for the wire to be worked by the wire drawing process and the like at a later stage. It is further preferable that the C+N content is in the range of between 0.20 mass % and 0.30 mass %

Also, for reducing further a diameter of the automotive electric wire for the weight saving, adequate adjustment of the tensile strength and toughness of the stainless steel wire is required. After having studied this issue, the inventors have found that when produced under the following conductions, the stainless steel wire can obtain adequate strength and toughness for the conductor of the automotive electric wire. Preferably, the stainless steel wire used in the present invention is drawn in the wire drawing process at a reduction in area of between 5% and 98%, to be adjusted in diameter to a predetermined diameter of wire and thereafter is heat-treated at a temperature of between 950° C. and 1,150° C. for a retention time of between 0.5 sec. and 60 sec. Further preferably, the stainless steel wire used in the present invention is drawn at a reduction in area of between 5% and 70% and thereafter heat-treated at a temperature of between 1,000° C. and 1,100° C. for a retention time of between 0.5 sec. and 20 sec. When the heat treatment is carried out at a lower temperature within the above-said temperature range, the retention time should preferably be made longer. On the other hand, when the heat treatment is carried out at a higher temperature within the above-said temperature range, the retention time should preferably be made shorter. When the heat treatment is carried out at a temperature less than 950° C., it becomes hard to apply sufficient heat to the stainless steel wire, so that there is a possibility that the stainless steel wire may become deficient in toughness. On the other hand, when the heat treatment is carried out at a temperature more than 1,150° C., the stainless steel wire is heated excessively, so that there is a possibility that the stainless steel wire may become deficient in toughness due to generation of a δ phase, as well as in strength. When the retention time is less than 0.5 sec., it becomes hard to apply sufficient heat to the stainless steel wire due to short heat treatment, so that there is the possibility that the stainless steel wire may become deficient in toughness. On the other hand, when the retention time is more than 60 sec., there is a possibility that the generation of the δ phase may be accelerated in the heat treatment at a high temperature, then causing production cost increase with ease industrially.

Further, it is preferable that the stainless steel wire after heat-treated and before twisted with the second element wire has a lower limit of the tensile strength of 800 N/mm$^2$ in consideration of the fact that the stainless steel wire is a wire to dominate a conductor strength, and has an upper limit of the tensile strength of 1,200 N/mm$^2$ in consideration of the workability of the stranding process. Further preferably, it has the limit ranging from not less than 900 N/mm$^2$ to less than 1,100 N/mm$^2$.

For improvement in corrosion resistance of the stainless steel wire, it is preferable that the stainless steel wire includes a minimum or no martensitic phase which is induced by the wiring process such as the wire drawing process and the stranding process. After having studied this issue, the inventors have found that in order for the stainless steel wire to obtain a corrosion resistance to withstand the use for the automotive wire harness, it is preferable that the stainless steel wire comprises not more than 10% by volume strain induced martensitic phase and the balance consisting primarily of the austenite phase. Further preferably, the stainless steel wire contains not more than 5% by volume strain induced martensitic phase.

The strain induced martensitic phase is affected by interrelation between phase stability of the austenite phase and conditions of the wiring process (reduction in area and heat-treatment conditions). For example for controlling a strain induced martensitic phase content to not more than 10% by volume in a common wiring process at a room temperature, it is effective that the stainless steel wire is allowed to contain C and N within the range specified above to provide phase stability of the austenite phase. In the wiring process, the lower the ambient temperature around the stainless steel wire is, the easier the martensitic phase is induced. In view of this, it is effective that the processing temperature is set to be higher by stopping cooling dies in the wire drawing process or by stopping cooling a reel for taking up the wire rod drawn.

In the following, the reasons for making a selection of the chemical compositions of the stainless steel wire and limiting a component range of the same will be described.

C is a strong austenite forming element. Also, it can enter the crystal lattice as an interstitial solute atom to cause strain of the crystal lattice, so as to strengthen the metal. Further, it can form the Cottrell atmosphere to anchor the dislocation in the metallographic structure. However, when Cr carbide exists in a crystal grain boundary, since Cr is diffused into the austenite phase slowly, a layer deficient in Cr is generated around the crystal grain boundary, causing reduction in toughness and in corrosion resistance. In view of this, an effective C content is set to be in the range of between 0.01 mass % and 0.25 mass %.

Similar to C, N is also a strong austenite forming element and an interstitial solid solution strengthening element. In addition, it is a Cottrell atmosphere forming element as well. However, it has a limit to enter the γ phase as the solid soluble atom. Accordingly, the addition of a large amount of N (0.20 mass % or more, particularly exceeding 0.25 mass %) causes generation of blowholes in the melting and casting processes. This phenomenon can be suppressed to a certain extent by addition of elements of high affinity to N, such as, for example, Cr and Mn, to expand the solid solubility limit. However, when such an element is added excessively, temperature and atmosphere must be controlled in the melting process, then causing possible cost increase. Therefore, in the prevent invention, an N content is set to be in the range of between 0.01 mass % and 0.25 mass %.

Mn is used as a deoxidizing agent in the melting and refinery processes. Mn is useful for providing phase stability of the γ phase of the austenitic stainless steel as well, so it can be used as a substitute element for expensive Ni. Also, it can work to expand the above-said solid solubility limit of N entering the γ phase, but it adversely affects on oxidation resistance at high temperature. Therefore, the Mn content is preferably in the range of between 0.5 mass % and 4.0 mass %. To take particular note of corrosion resistance, the Mn content in the range of 0.5 mass % and 2.0 mass % is preferable. For expanding the solid solubility limit of N or minimizing the likelihood of generation of microscopic blowholes from N as possible, the addition of the Mn content in the range of between exceeding 2.0 mass % and 4.0 mass % is very effective, though the corrosion resistance is somewhat reduced. Thus, the Mn content can be adjusted for intended purposes.

Cr is a major constituent element of the austenitic stainless steel and is a useful element for obtaining the heat resistance and the oxidation resistance. In the present invention, by calculating equivalent Ni and equivalent Cr from other elemental components and allowing for the phase stability of the γ phase, the Cr content is set to be in the range of from not less than 16 mass % to obtain heat resistance required for the wire harness to not more than 20 mass % to allow for deterioration in toughness.

Ni is useful for obtaining the phase stability of the γ phase. In the present invention, when the N content is set to be in the range of not less than 0.2 mass %, the addition of a large amount of Ni may cause the generation of the blowholes. For avoidance of this, the addition of Mn of high affinity to N is effective. To well produce the austenitic stainless steel, an amount of Ni added must be figured out considering an amount of Mn added. In the present invention, the Ni content is set to be in the range of from not less than 8.0 mass % to obtain the phase stability of the γ phase to not more than 14 mass % to prevent the generation of the blowholes and the cost increase. Although the Ni content is preferably in the range of between 8.0 mass % and 14 mass %, as mentioned above, the Ni content in the range of less than 10 mass % can facilitate the solid solution of N in the melting and casting processes, in particular, which can provide the advantageous result of providing further reduction in production cost.

(Second Element Wire)

In the present invention, a wire comprising at least one material selected from the group consisting of copper, copper alloy, aluminum, and aluminum alloy is used as a second element wire. When two or more second element wires are used, the same material may be used for all of them or different materials may be used in combination. When aluminum wire or aluminum alloy wire is used as the second element wire, weight saving can be provided, as compared with copper wire and copper alloy wire. Materials used for the copper wire include chemical components comprising copper and unavoidable impurities. Materials used for the copper alloy wire include chemical components comprising copper, at least one material selected from the group consisting of Sn, Ag, Ni, Si, Cr, Zr, In, Al, Ti, Fe, P, Mg, Zn, and Be, and unavoidable impurities. Materials used for the aluminum wire include chemical components comprising aluminum and unavoidable impurities. Materials used for the aluminum alloy wire include chemical components comprising aluminum, at least one material selected from the group consisting of Mg, Si, Cu, Ti, B, Mn, Cr, Ni, Fe, Sc, and Zr, and unavoidable impurities.

(Composite Wire)

The composite wire of the present invention is produced by combining the first element wire comprising the stainless steel wire mentioned above and the second element wire comprising a metal wire comprising copper and the like mentioned above and twisting them together. One or more wires are used for each of the first element wire and the second element wire. As a rate of content of the first element wire increases, strength of the composite wire increases on one hand, but conductor resistance of the same tends to increase on the other hand. On the other hand, as a rate of content of the second element wire increases, conductor resistance of the composite wire decreases on one hand, but strength of the same tends to decrease on the other hand. Accordingly, the number of the first element wires and second element wires may be properly selected so that adequate conductor resistance and strength can be obtained.

Effect of the Invention

As described above, the wire-harness use composite wire according to the present invention comprises the stainless steel wire (the first element wire) comprising specific chemical composition and the second element wire comprising copper and the like, the first element wire and the second element wire being twisted together. This construction can produce the excellent results of providing improved corrosion resistance as well as superior electrical conductivity and strength for the conductor of the automotive electric wire. Also, in the composite wire of the present invention, since the stainless steel wire is used in combination, an amount of copper used can be reduced, thus producing the result of the weight saving. Further, since the composite wire of the present invention can be produced with comparative ease, without any need of the conventional production processes, such as the cladding and the plating, the production costs can also be reduced. The use of this wire-harness use composite wire of the present invention for the conductor of the automotive electric wire can contribute to improvement in weight saving and recycling efficiency of the entire automobile, thus being very effective and also high industrial value for the brown issues in the future.

BEST MODE FOR CARRYING OUT THE INVENTION

In the following, an embodiment of the present invention is described.

EXAMPLE 1

After a composite wire was produced using a stainless steel wire and a copper wire, the composite wire were examined for the characteristics. Chemical composition of the stainless steel wire used is shown in TABLE 1. Stainless steel type II shown in TABLE 1 is a common austenitic stainless steel of SUS304 specified by JIS (Japanese Industrial Standards).

TABLE 1

Chemical composition of stainless steel wires (mass %)

| Type of Stainless Steel | C | Si | Mn | Ni | Cr | N | C + N |
|---|---|---|---|---|---|---|---|
| Stainless steel I | 0.07 | 1.0 | 2.1 | 8.7 | 18.3 | 0.19 | 0.26 |
| Stainless steel II | 0.04 | 0.6 | 1.4 | 9.7 | 18.3 | 0.02 | 0.06 |

Stainless steel wire rods (a wire diameter of ϕ 0.43 mm) were produced by melting, casting, forging, and hot-rolling the stainless steels comprising the chemical composition shown in TABLE 1 (Stainless steels I and II). After having drawn in the wire drawing process at a reduction in area of 86%, the stainless steel wire rods were heat-treated for annealing to obtain stainless steel wires having a wire diameter of ϕ 0.16 mm. The heat-treatment for annealing was carried out at a temperature of 1,100° C. for a retention time of about 5 sec. Tensile strengths of these stainless steel wires are shown in TABLE 2.

TABLE 2

Sizes and tensile strengths of stainless steel wires

| Type of element wire | Type of stainless steel | Reduction in area in wire drawing process (%) | Wire diameter (mm) | Tensile strength after heat treatment ($N/mm^2$) |
|---|---|---|---|---|
| Stainless steel wire I | Stainless steel I | 86 | 0.16 | 903 |
| Stainless steel wire II | Stainless steel II | 86 | 0.16 | 762 |

It can be seen from TABLE 2 that even when heat-treated for annealing to provide improved toughness, the stainless steel wire I has a high tensile strength, as compared with the stainless steel wire II of SUS304. It can be seen from this that the stainless steel wire I is excellent in both of tensile strength and toughness. When the stainless steel wire I after heat-treated was examined for the metallographic structure, it was found that it consisted substantially of an austenite phase with substantial no strain induced martensitic phase.

An annealed wire consisting primarily of pure copper and commonly use for the wire harness was used as the copper wire. The copper wire of a wire diameter of ϕ 0.16 mm to be twisted together with the stainless steel wire was prepared. For comparison with the composite wire, a twisted wire of a copper wire only was also produced. This copper wire prepared had a wire diameter of ϕ 0.23 mm.

The composite wires and the twisted copper wires were produced using seven wires in combination out of those prepared as mentioned above (the stainless steel wires and the copper wires) and twisting them together. Then, the composite wires and the copper wires were coated with vinyl chloride to a predetermined thickness, to form an insulating layer around the outside of each of the composite wires and the copper wires. Electric wires using those composite wires and twisted copper wires as the conductor were produced.

Test Example 1

The electric wires obtained were measured for breaking load of conductor, conductor resistance, mass of conductor, and mass of wire. The results are shown in TABLE 3.

TABLE 3

| Sample No. | Wire type | Diameter of wire (mm) | Strand-ratio stainless steel wire:copper wire | Breaking load (N) | Conductor resistance (mΩ/m) | Mass of conductor (g/m) | Mass of wire (g/m) |
|---|---|---|---|---|---|---|---|
| 1 | I | 0.16 | 4:3 | 82.3 | 328 | 1.2 | 2.0 |
| 2 | I | 0.16 | 5:2 | 101.8 | 598 | 1.2 | 2.0 |
| 3 | I | 0.16 | 1:6 | 50.2 | 139 | 1.3 | 2.0 |

TABLE 3-continued

| Sample No. | Wire type | Diameter of wire (mm) | Strand-ratio stainless steel wire:copper wire | Breaking load (N) | Conductor resistance (mΩ/m) | Mass of conductor (g/m) | Mass of wire (g/m) |
|---|---|---|---|---|---|---|---|
| 4 | I | 0.16 | 6:1 | 125.1 | 621 | 1.1 | 1.9 |
| 5 | II | 0.16 | 4:3 | 70.4 | 331 | 1.2 | 2.0 |
| 6 | II | 0.16 | 5:2 | 93.2 | 587 | 1.2 | 2.0 |
| 7 | — | 0.16 | 0:7 | 32.8 | 127 | 1.3 | 2.1 |
| 8 | — | 0.23 | 0:7 | 81.2 | 47 | 3.4 | 3.8 |

It can be seen from TABLE 3 that Samples No. 1-4 have breaking load equal to or more than the twisted wire of the copper wire only (Sample No. 8) and are superior in tensile strength. It can also be seen that in these samples, the mass of wire can be reduced to half or less than half. Also, it can be seen from comparison with the twisted copper wire having the same strand diameter but comprising the copper wire only (Sample No, 7) that Samples No. 1-4 are even higher in breaking load and thus superior in tensile strength and also the mass of wire is reduced.

If wiring resistance is supposed to be, for example, a voltage drop of 0.5V, a load current of 0.5 A, and a wiring length of 1.5 m, the conductor resistance of the automotive electric wire is required to be not more than 667 mΩ/m. It can be seen that Samples No. 1-4 fully satisfies this requirement.

Further, it can be seen from comparison between Samples No. 1 and No. 5, and between Samples No. 2 and No. 6 which are equal in strand-ratio of stainless steel wire to copper wire that Samples No. 1 and No. 5 and Samples No. 2 and No. 6 are substantially equal in conductor resistance, but Samples No. 1 and No. 2 are larger in breaking load by 10N or more. It can be seen from this that Samples No. 1 and No. 2 using the specific stainless steel wire are superior in tensile strength to the wires using the JIS specified stainless steel of SUS304. For making Samples No. 5 and No. 6 using the JIS specified stainless steel of SUS304 substantially equal in tensile strength to Samples No. 1 and No. 2, the stainless steel wire II must be drawn once or twice in the wire drawing process at a reduction in area of 20% to 30%. Although such a process can allow the stainless steel wire II to increase in tensile strength by an increased strain induced martensite phase, corrosion resistance tends to deteriorate easily, as mentioned later. In contrast to this, since Samples No. 1 and No. 2 using the stainless steel wire I of specific composition can be produced without any need of the wire drawing for improved tensile strength, the corrosion resistance can be prevented form being deteriorated by such a process and also workability can be improved.

These test results are just examples resulting from the use of the composite wire as the wire harness, and the product configuration and the numeric data obtained do not indicate the applicability to all intended applications. However, these test results can be considered to show that when the composite wire is demanded to satisfy both of high tensile strength and high conductivity, the composite wire of the present invention can accomplish the demanded object with relative ease. Also, the present invention can provide improved conductivity by using the stainless steel wire having high tensile strength in combination for reducing an amount of copper wire used.

Test Example 2

Next, the samples were evaluated for corrosion resistance. The samples used in this corrosion resistance test were the composite wires of Sample Nos. 1, 2, 5, and 6 used in the test example 1 and newly prepared ones (Sample Nos. 9 and 10) varied in strain induced martensite content ratio. Sample No. 9 used a stainless steel of the same chemical composition as the stainless steel used in Sample No. 1 (stainless steel I), and Sample No. 10 used a stainless steel of the same chemical composition as the stainless steel used in Sample No. 5 (stainless steel II). Samples No. 9 and No. 10 were varied in strain induced martensite content ratio by varying conditions for the wire drawing process. Concretely, these stainless steel wires were drawn in the wire drawing process at a higher reduction ratio (at the reduction in area of 96%) and heat-treated for annealing the stainless steel wire II of Sample 10 at a lower temperature (temperature of 1,050° C.×retention time of 2 sec.) and also an ambient temperature around the stainless steels was made lower, whereby the stainless steel wires were increased in strain induced martensite content ratio. The tensile strength of Sample No. 9 using the stainless steel wires after heat-treated was 1,187 N/mm$^2$.

The corrosion resistance test was carried out at a temperature of 35° C. for a test period of one month, using a salt spray tester and salt water (5% salt water)(artificial seawater).

TABLE 4

Salt spray test results

| Sample No. | Martensite content ratio of stainless steel wire (percent by volume) | Rust development area ratio (%) | | |
|---|---|---|---|---|
| | | Contact zone of stainless steel and copper | Stainless steel wire | Copper wire |
| 1 | 0 | 40 | 0 | 15 |
| 2 | 0 | 40 | 0 | 15 |
| 9 | 3 | 50 | 5 | 20 |
| 5 | 7 | 60 | 15 | 40 |
| 6 | 7 | 60 | 15 | 40 |
| 10 | 37 | 70 | 30 | 70 |

Stainless steel and copper are different in ionization tendency, due to which electric cell is formed in a contact zone of the stainless steel wire and the copper wire. It can be confirmed from TABLE 4 that corrosion develops in the contact zone. Also, it was observed that corrosion of the copper wire started at the contact zone and further a copper corrosion product exerted a bad effect on the stainless steel wire. In addition, it can be seen that Samples No. 1 and 2 produced with the strain induced martensite phase controlled by the specific composition are superior in corrosion resistance to Samples No. 5 and 6 using SUS304. It can also be seen that Sample No. 9 produced with the strain induced martensite phase controlled by the wiring process conditions in addition to the specific composition is superior in corrosion resistance to Sample No. 5. It can be particularly confirmed from TABLE 4 that the higher a martensite content ratio of stainless steel wire (per cent by volume), the further corrosion develops. It can be seen from this that the process to increase the martensite phase can provide improved tensile strength on one hand, but on the other hand the corrosion resistance is deteriorated.

EXAMPLE 2

The composite wire was produced in the same manner as in Example 1 using an aluminum wire of a wire diameter of ϕ 0.16 mm comprising pure aluminum (including unavoidable impurities) in place of the copper wire of Example 1 described above. Then, the electric wires using the composite wire as the conductor were produced and measured for breaking load, conductor resistance, mass of conductor, and mass of wire in the same manner as in Example 1. It was confirmed from the measurement results that the composite wire was able to satisfy both of high tensile strength and high conductivity, as is the case with Example 1. It was also confirmed that the composite wire was able to provide further improved weight saving.

Although the conductor formed by aluminum wire, aluminum alloy wire, or copper alloy wire only is in general superior in tensile strength, as compared with the conductor formed by copper wire only, the tensile strength is not so greatly enhanced. Due to this, the conductor formed by aluminum wire, aluminum alloy wire, or copper alloy wire only cannot be expected to provide an enhanced tensile strength particularly when reduced in diameter for the weight saving of the electric wire. In contrast to this, the present invention does not take the form of the aluminum wire only, but takes the form of the twisted wire formed by combination with the stainless steel. This can allow the composite wire to respond flexibly to the demand characteristics for tensile strength, conductively, and weight saving.

Example 2 was evaluated for the corrosion resistance in the same matter as in the test example 2. When the aluminum wire, its alloy wire, or the copper alloy wire is used as the second element wire, characteristic of the electric cell formed between such the above metal wires and the stainless steel wire differs slightly. It was confirmed however that by using the stainless steel wire of a strain induced martensite content ratio of not more than 10 per cent by volume, the composite was able to provide the same excellent corrosion resistance as in the test example 2

INDUSTRIAL APPLICABILITY

The wire-harness use composite wire of the present invention is suitably used as the conductor of the wire harness arranged in the automobile.

The invention claimed is:

1. A composite wire for wire-harness comprising a first element wire which comprises 0.01-0.25 mass % C, 0.01-0.25 mass % N, 0.5-4.0 mass % Mn, 16-20 mass % Cr, 8.0-14.0 mass % Ni, and the balance of Fe and impurities and satisfies that a C+N content is in the range of 0.15 mass %≦C+N≦0.30 mass %, and a second element wire comprising at least one material selected from the group consisting of copper, copper alloy, aluminum, and aluminum alloy, the first element wire and the second element wire being twisted together, wherein the first element wire is drawn in a wire drawing process at a reduction in area of between 5% and 98%, to be adjusted to a predetermined diameter of wire and thereafter is heat-treated at a temperature of between 950° C. and 1,150° C. for a retention time of between 0.5 sec. and 60 sec. so that a tensile strength of the first element wire to be twisted together with the second element wire is in the range of between 800 N/mm$^2$ and less than 1,200 N/mm$^2$.

2. The composite wire for wire-harness according to claim 1, wherein the first element wire comprises not more than 10% by volume of a martensitic phase induced by a wiring process and the balance consisting of an austenite phase.

3. A production method of a composite wire for wire-harness comprising:

drawing a stainless steel wire which comprises 0.01-0.25 mass % C, 0.01-0.25 mass % N, 0.5-4.0 mass % Mn, 16-20 mass % Cr, 8.0-14.0 mass % Ni, and the balance of Fe and impurities and satisfies that a C+N content is in the range of 0.15 mass %≦C+N≦0.30 mass % at a reduction in area of between 5% and 98%, to be adjusted to a predetermined diameter of wire, heat-treating the drawn wire at a temperature of between 950° C. and 1,150° C. for a retention time of between 0.5 sec. and 60 sec., and twisting at least one stainless steel wire obtained together with at least one metal wire comprising at least one material selected from the group consisting of copper, copper alloy, aluminum, and aluminum alloy, wherein a tensile strength of the stainless steel wire before twisted together is in the range of between 800 N/mm$^2$ and less than 1,200 N/mm$^2$.

* * * * *